United States Patent [19]

Spanel et al.

[11] 4,047,491

[45] Sept. 13, 1977

[54] MULTI-COLOR TUFTING MACHINE

[75] Inventors: Abram N. Spanel, Princeton, N.J.; P. Frank Eiland, Stamford; David R. Jacobs, New Canaan, both of Conn.

[73] Assignee: Abram N. Spanel, Princeton, N.J.

[21] Appl. No.: 699,904

[22] Filed: June 25, 1976

[51] Int. Cl.[2] ..... D05C 15/34

[52] U.S. Cl. ..... 112/79 A

[58] Field of Search ..... 112/79 R, 79 A, 79 FF, 112/80, 79.5, 221, 219 A; 139/449, 446

[56] References Cited

U.S. PATENT DOCUMENTS

| | | | |
|---|---|---|---|
| 2,522,582 | 9/1950 | Newman | 112/221 |
| 3,259,088 | 7/1966 | Rockholt | 112/79 R |
| 3,439,638 | 4/1969 | Zuk | 112/219 A |
| 3,554,147 | 1/1971 | Spanel | 112/79 R |
| 3,678,968 | 7/1972 | Juillard | 139/446 |
| 3,824,939 | 7/1974 | Spanel et al. | 112/79 FF |

*Primary Examiner*—H. Hampton Hunter
*Attorney, Agent, or Firm*—J. Rodman Steele, Jr.

[57] ABSTRACT

A tufting machine having multi-color selection capability in which an improved selection means enables the selection of one of a plurality of yarns which upon selection is pneumatically transported to a tufting station where a bit-length of yarn is severed and tufted to a backing layer. The selection process comprises individual selection band-like members which, upon selection by solenoid means, engage with an oscillating shaft from which said band-like members extend tangentially. The band-like members are connected to elements which are used to engage yarn and which feed, meter and pull back such yarn when they are driven by the oscillatory shaft.

19 Claims, 16 Drawing Figures

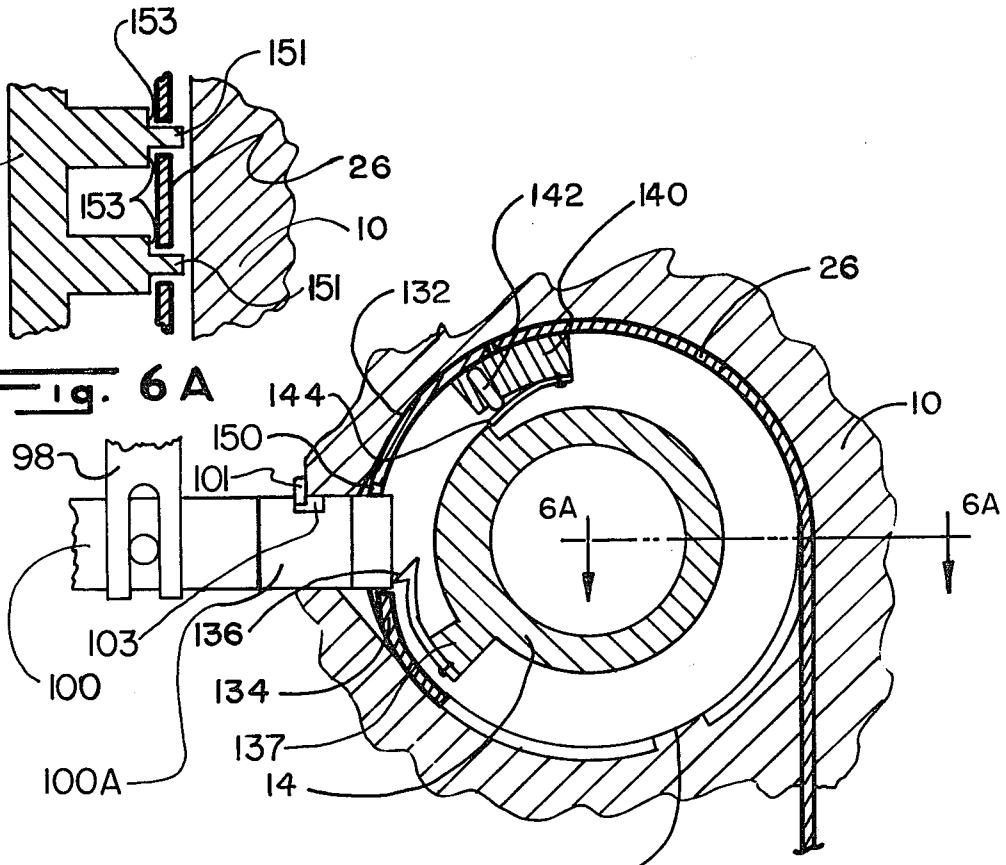
Fig. 6
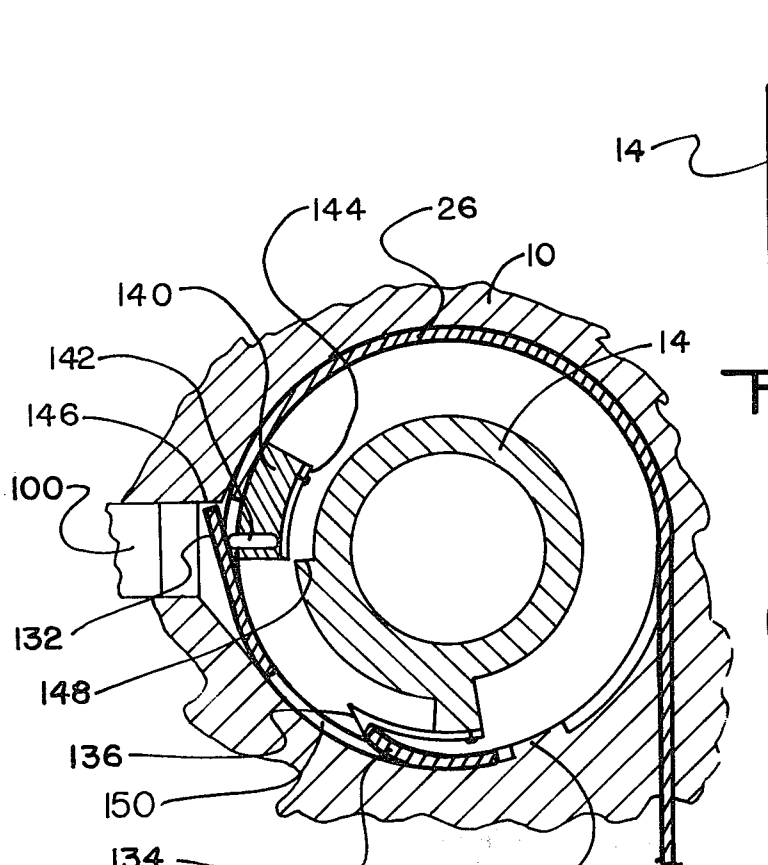
Fig. 6A
Fig. 5

Fig. 7
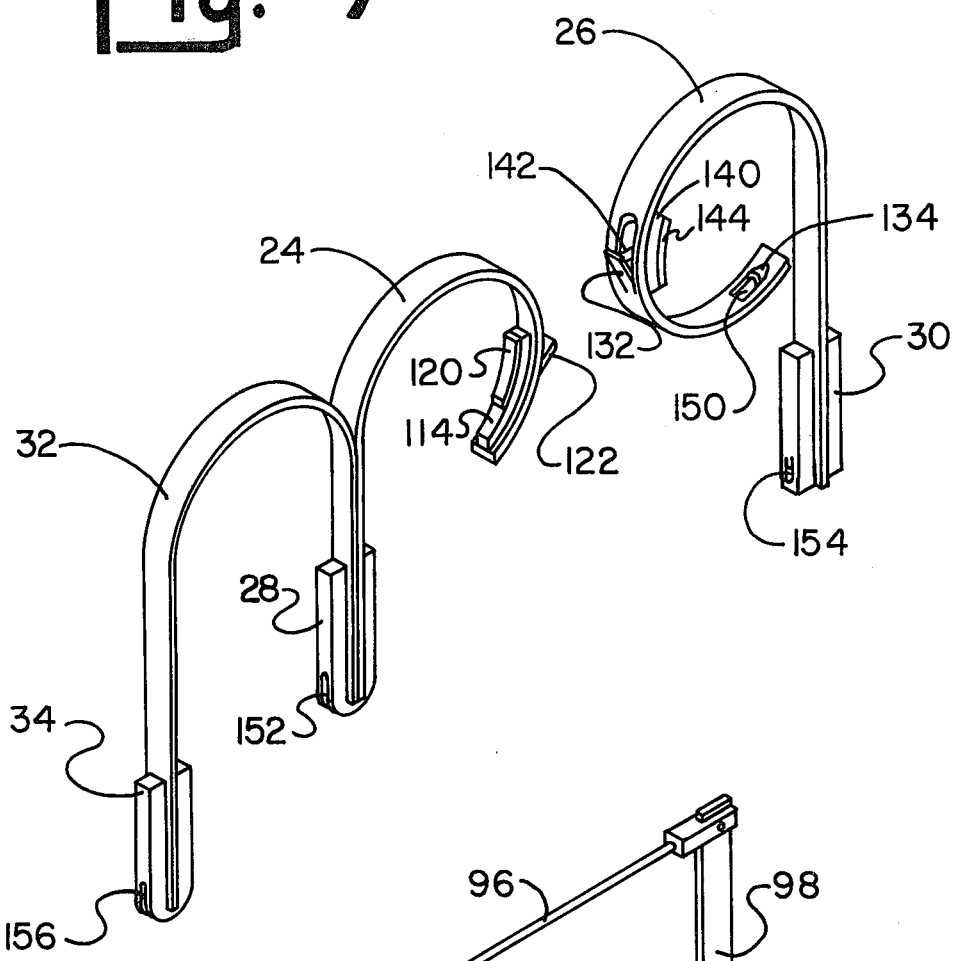
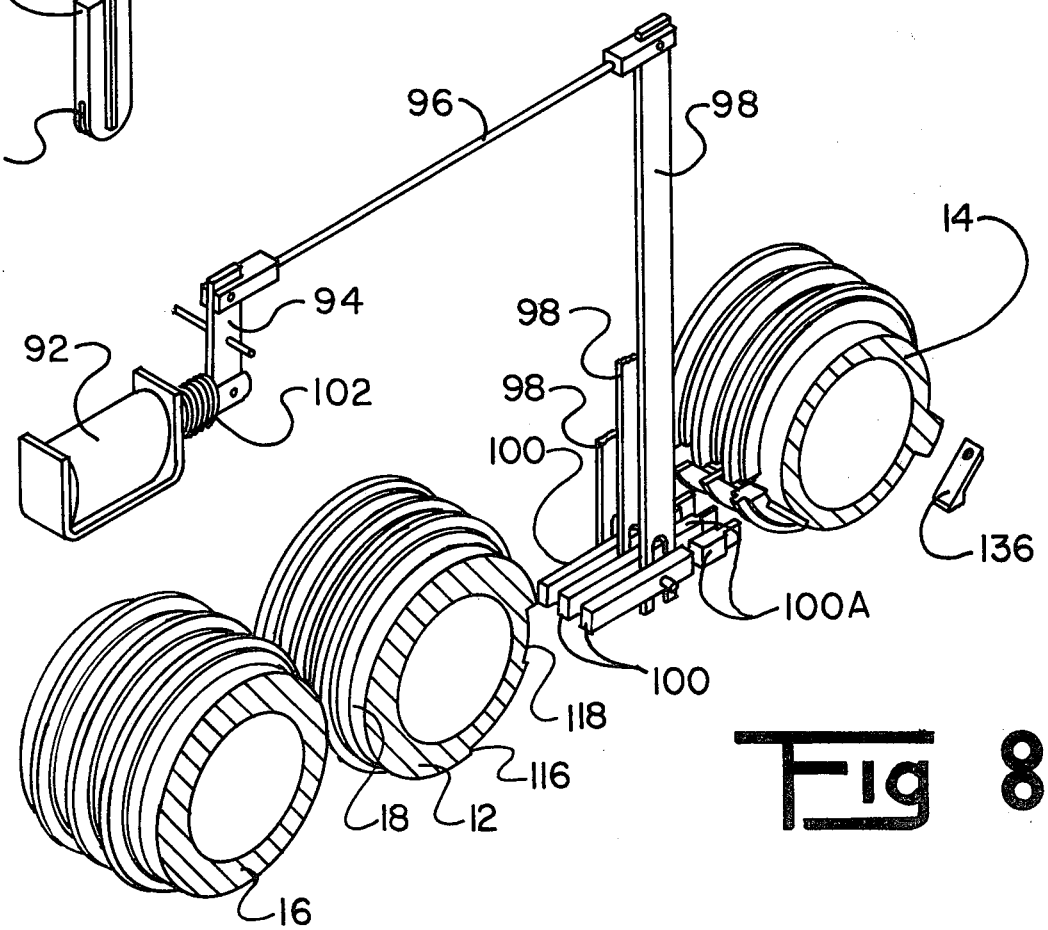
Fig 8

MULTI-COLOR TUFTING MACHINE

BACKGROUND OF THE INVENTION

The subject disclosure relates to selection mechanism for use in a multi-color tufting machine in which yarn is pneumatically transported to tufting stations and tufted to a backing layer. The mechanism and method of selection disclosed herein has particular utility in a system which has become known as the "Spanel Tufting System" invented by Abram N. Spanel, a co-inventor of the subject disclosure. Generally, the Spanel system utilizes pneumatic means to transport yarn to a tufting station, either in metered lengths of unsevered yarn or in discrete bits. After the transportation the yarn is tufted, by needle or other bit-applying elements to a backing layer to form a tufted product such as a rug.

The subject invention discloses a selection and feeding means which is of particular utility when used in the tufting system disclosed in U.S. Pat. No. 3,554,147 which issued to Abram N. Spanel and George J. Brennan on Jan. 12, 1971. This patent provides for the simultaneous selection of bit-lengths of yarn of various colors for each tufting cycle at each individual tufting station. A collator structure in which individual channels transport yarn into a common passageway adjacent the tufting station is utilized.

In the aforementioned Spanel (Brennan) patent, by way of example, three different colors are provided for each tufting station comprising individual bit-applying elements. From the creels, yarn strands are led into a metering device 12 which is shown to comprise a plurality of brakes and yarn-pullers or feeders. From the metering device 12, the yarns pass through a multi-strand selector mechanism 14. From each selector, there is a tube or passageway extending to or forming one input passage of a collator 16. Each of the tubes or passageways merges into a common single passageway 18 so that each yarn-bit, regardless of which color, will eventually be transported into the common passageway 18 which feeds each of the individual bit-applying elements or needles. The metering device in aforementioned U.S. Pat. No. 3,554,147 comprised yarn-brakes 12A, 12B, 12C and yarn-pullers 12X and 12Y, all of which were individually actuated but which would coact to meter a bit-length of yarn of predetermined length to be available for selection and subsequent transportation to the tufting station. While theoretically similar in operation to aforementioned U.S. Pat. No. 3,554,147, the subject application discloses improved operational techniques and means which supplement the teachings of the aforementioned U.S. Pat. No. 3,554,147 and contribute to improved efficiency of the Spanel Tufting System.

In addition to aforementioned U.S. Pat. No. 3,554,147, other Spanel patents which disclose related tufting techniques are: U.S. Pat. No. Re.27,165; U.S. Pat. No. 3,937,157; U.S. Pat. No. 3,937,158; U.S. Pat. No. 3,937,159; U.S. Pat. No. 3,937,160; U.S. Pat. No. 3,824,939, and U.S. Pat. No. 3,937,156.

Reference is also made to copending Application Ser. No. 699,905 which covers some of the basic techniques disclosed herein, as well as copending Application Ser. Nos. 700,413 and 699,906 in which related operations are disclosed.

SUMMARY OF THE INVENTION

In accordance with the subject invention, a multi-color tufting machine is disclosed in which pneumatic means is utilized to transport selected yarn strands to a tufting station. The selection means comprises individual band selection members which are used to engage individual yarn strands for metering and yarn pullback purposes. When an individual yarn of a particular color is selected, solenoid means is actuated and causes the respective band member to be engaged by a continuously oscillating drive shaft. Each of the selection band members is confined in a track around said oscillating shaft and extends tangentially within a linear track to a yarn engaging end remote from said oscillating shaft. An idler shaft with a second band member connected to said first band member may be used to prefeed a desired bit-length of yarn for subsequent metering purposes.

Yarn which is fed into a common passageway adjacent the tufting station must be withdrawn from the common passageway after severance of a bit-length of yarn and a pullback band member with accompanying plunger means is utilized for this purpose, said pullback band also being engageable with an oscillating drive shaft upon actuation. This pullback structure can also be used to control the pneumatic pressure since when the pullback means is released, pneumatic pressure must be utilized to transport the yarn strand to the tufting station since the yarn metering means operates at a different time during a cycle from the pullback means. The two units may be operated by a single solenoid.

BRIEF DESCRIPTION OF THE DRAWINGS

For a more detailed understanding of the invention, reference is made in the following description to the accompanying drawings in which:

FIG. 5 is a plan view showing in cross-section the oscillatory member for the yarn pullback apparatus, together with the yarn pullback band means;

FIG. 6 is similar to FIG. 5 only the pullback band is shown in its actuated position;

FIG. 6A is a cross-sectional view taken through a portion of oscillating shaft 14 along the lines 6A—6A in FIG. 6;

FIG. 7 is an isometric view showing the yarn metering and pullback bands together with their plunger members;

FIG. 8 is an isometric view showing the oscillating shafts and the solenoid actuation means for the yarn metering and yarn pullback functions;

DETAILED DESCRIPTION OF THE DRAWINGS

Figure 1:
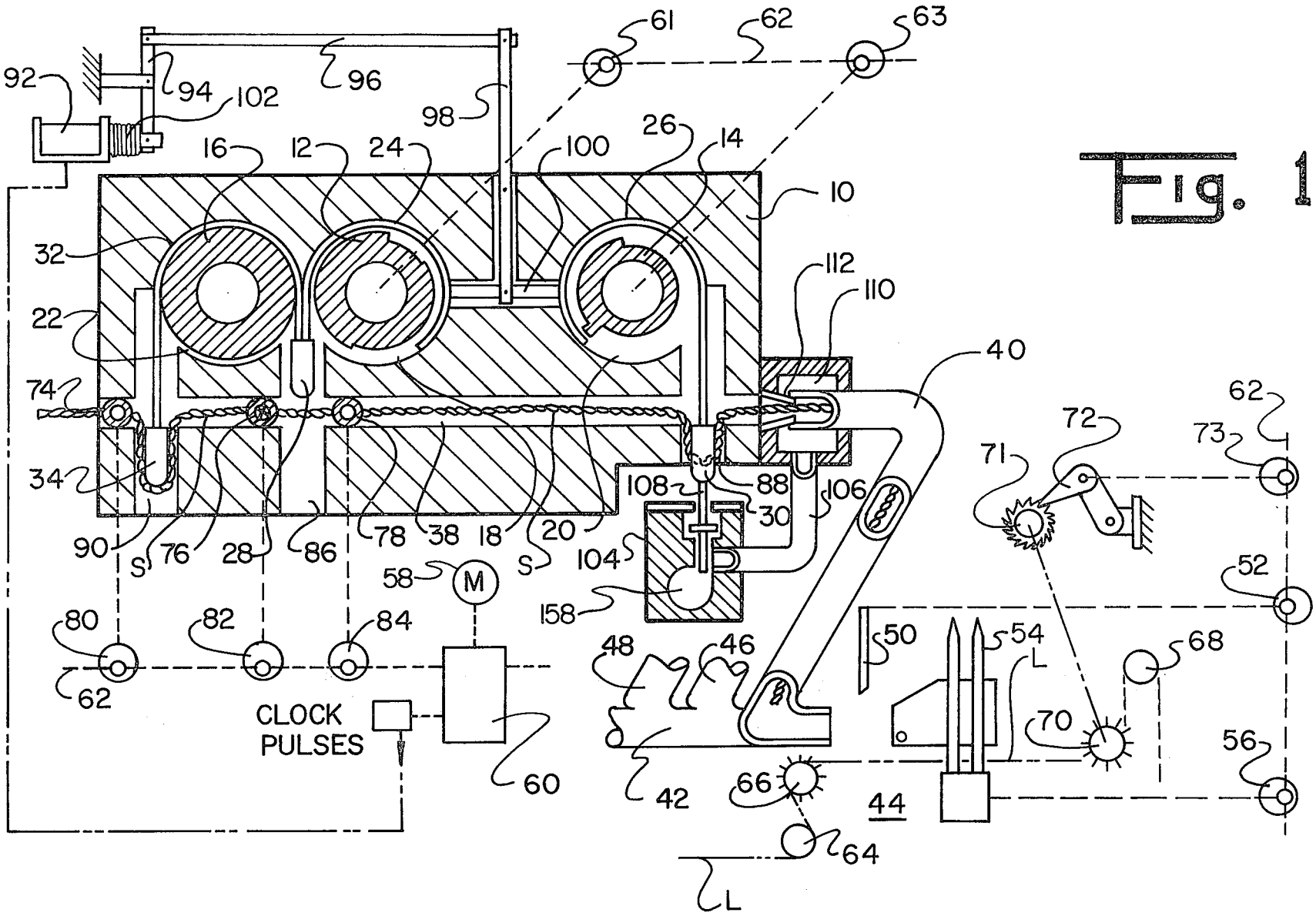
FIG. 1 is a schematic view of a tufting machine.

With reference to FIG. 1, a schematic view of one operational unit of the multi-color tufting machine is shown. Housing 10 is shown as being configurated to house oscillating drive shafts 12 and 14. Drive shaft 12 is the yarn feed drive shaft while drive shaft 14 is the pullback drive device. Both of drive shafts 12 and 14 are constantly oscillating. Shaft 16 is an idler shaft which is used in conjunction with the yarn feeding system. Circumferential grooves or tracks 18, 20 and 22 exist between shafts 12, 14 and 16, respectively, and the surrounding wall structure of the housing 10. Thin band-like members or ribbons 24 and 26 are engageable in a manner, which will be discussed later in detail, by oscillating shafts 12 and 14, respectively. Band-like members 24 and 26 are connected to yarn displacement plungers 28 and 30, respectively, which serve as yarn feed and yarn pullback plungers, respectively. Also connected to yarn feed plunger 28 is band-like member or ribbon 32 which extends over idler shaft 16 through groove 22 and terminates in a second yarn feed plunger 34. A yarn feed channel 38 extends from a yarn creel (not shown) through the housing to the input tube or passageway 40 in which the yarn is pneumatically transported through a collator structure to a common passageway 42. As schematically shown, the yarn passageway 42 leads to the tufting station 44. It will be seen that in addition to input tube or passageway 40, additional input passageways 46 and 48, which come from similar operational units, are shown leading into common passageway 42. It is to be clearly understood that any number such as 5 or 8 yarn metering and feeding units may be used for each tufting station to provide multi-color capability for each set of needles. Identical yarn feed and pullback systems as above discussed are associated with each of the input passageways that lead into the collator structure.

The tufting system 44 may be on the order of that disclosed in aforementioned U.S. Pat. No. 3,554,147. Yarn severing means 50 is shown being controlled by cam member 52 while needles 54 are shown being driven by cam member 56. The needles 54 may be dual shank needles having aligned eyes on the order of those disclosed in aforementioned U.S. Pat. Nos. 3,554,147 and Re27,165. In accordance with the operation disclosed in the aforementioned patents, a discrete bit-length of yarn is placed through the aligned eyes in the needle shanks and pulled or driven through a backing layer by the needles 54.

It is to be understood that in place of needles 54, stomper-like bit-applying elements as disclosed in U.S. Pat. No. Re27.165 may be used to push the discrete bit-lengths of yarn into adhesive attachment with a backing layer.

A motor 58 is shown driving the tufting apparatus through transmission 60 which may be a train of gears or related mechanism. A power transmission means 62 is schematically shown running throughout the device from which the various drive mechanisms operate. As shown, yarn servering cam means 52 and needle cam means 56 operate off of power transmission means 62. Additionally, it will be noted that drive shafts 12 and 14 operate by cams 61 and 63.

A backing layer L onto which yarn is tufted is shown extending through tufting station 44. The backing layer L is fed from idler roll 64 and feed roll 66, around feed roll 70 to the take-up roll 68. The feed roll 70 is shown being controlled by ratchet 71 and pawl means 72 as driven by power transmission means 62.

Yarn clamps 74, 76 and 78 are shown positioned in yarn feed channel 38 and operate by cam members 80, 82 and 84 respectively. As seen from FIG. 1, plungers 28, 30 and 34 and their respective bands extend and operate into channels 86, 88 and 90. A yarn strand S is shown extending through the yarn feed channel 38 and down into plunger channels 90 and 88 as is required during the yarn control and feeding sequence. Control of the yarn will be subsequently described in detail.

A selection actuation means which may be a solenoid 92 receives control signals for selective actuation of the feeding and pullback functions. Pattern information such as recorded on tape, drums or other medium is converted into electrical or other type signals as shown by clock pulses which are then transmitted to the solenoid selection actuation means 92. Intermediate elements 94, 96 and 98 are used to drive the actuation pin 100 responsive to the solenoid conditions. Normally, due to the spring-biasing effect of spring 102, the actuation pin 100 is caused to be in engagement without pullback band 26 which as will be discussed causes the yarn to be in a pulled-back condition. Upon actuation of solenoid 92, the spring biasing of spring 102 is overcome and actuation pin 100 disengages from band (thus ending the yarn pullback condition) and engages with band 24 which, as will subsequently be discussed in detail, causes the yarn feeding to occur.

It will be noted that control of yarn pullback plunger 30 is related to the control of the pneumatics for the yarn transportation system. An air manifold 104 provides the air supply from a compressor (not shown) for air conduit 106 as permitted by valve means 108 which is in a closed position when pullback plunger 30 is lowered to pull yarn from the common throat 42. The air conduit supplies air chamber 110 through which air is supplied to yarn tube or passageway 40 through entering nozzle 112.

Having briefly described elements of the subject invention generally, these elements and their components will now be described in detail.

Figure 2:
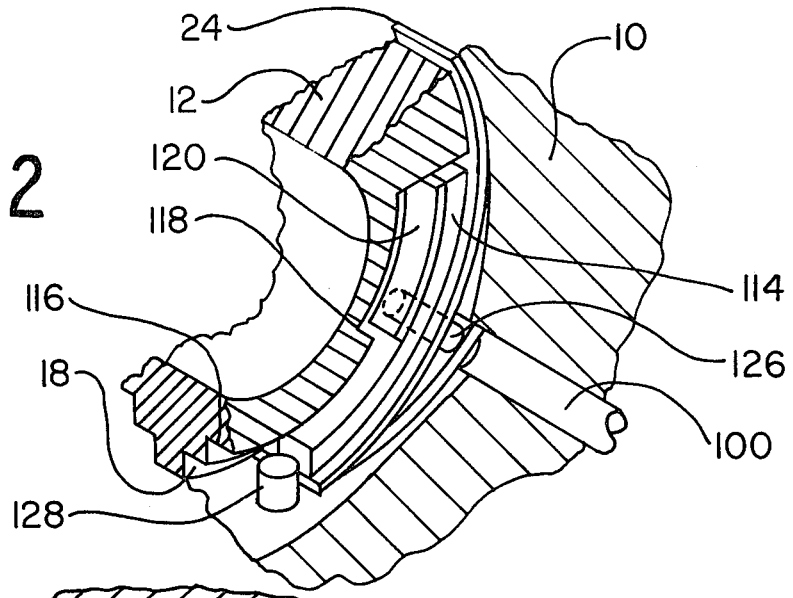
FIG. 2 is an isometric cutaway view showing oscillatory member and band actuation structure.
Figure 3:
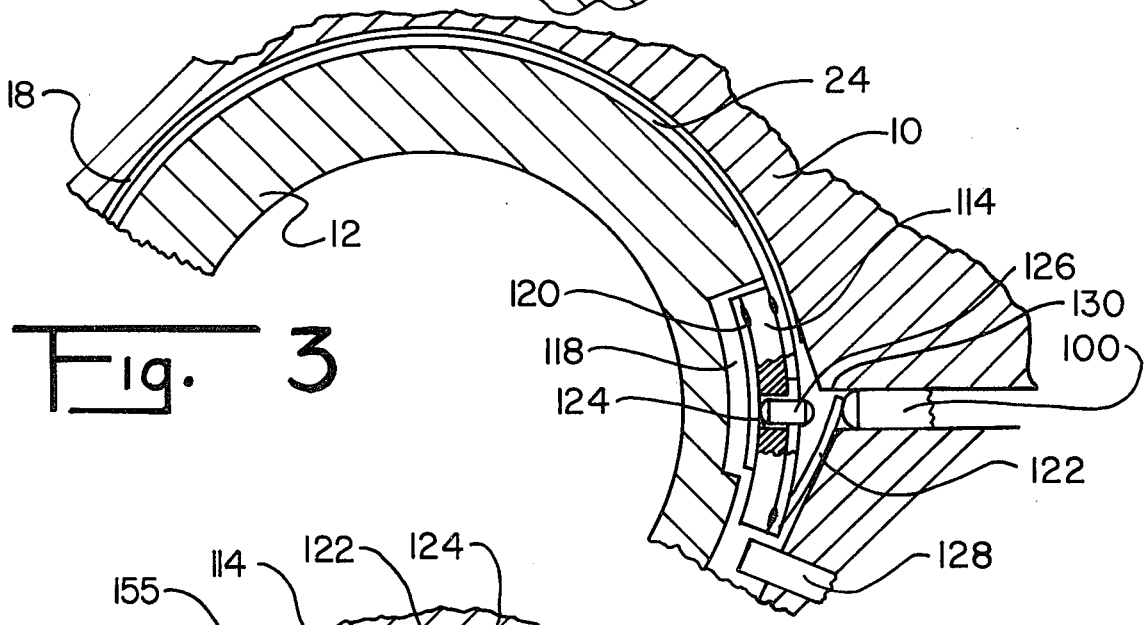
FIG. 3 is a cross-sectional plan view of the mechanism of FIG. 2 with the solenoid in an off position.
Figure 4:
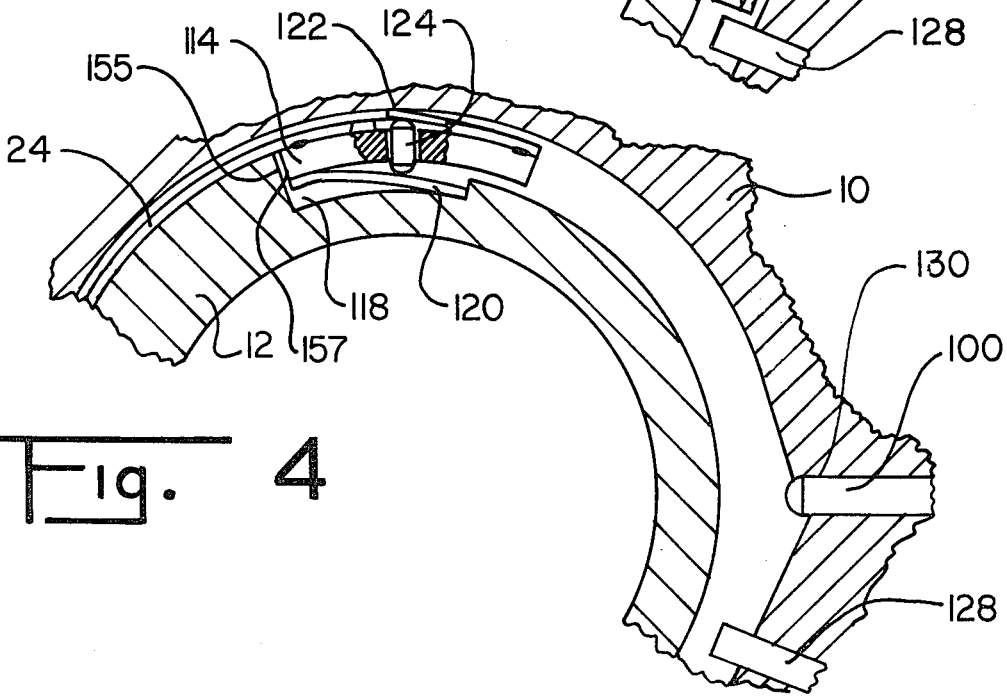
FIG. 4 is a cross-sectional plan view of the mechanism of FIG. 2 with the solenoid in its on position.

With reference to FIGS. 2–4, a view is shown of the mechanism which causes the engagement of band-like member 24 with oscillating drive shaft or tube 12. The band-like member or ribbon 24 is contained in channel 18 of oscillating shaft and while it may slide, it has no room to bend when subjected to compression forces. As will be recalled from FIG. 1, the band or ribbon 24 extends to plunger 28 which is in the stationary channel 86 below the oscillatory shaft 12. The band or ribbon 24 extends from plunger 28 around the shaft 12 for approximately 180° and terminates in a shoe 114. As can best be seen from FIG. 2, shaft 12 closely fits within the cavity formed in housing 10 and groove 18 which carries band 24 is actually the shallowest of three grooves or notches in shaft 12. An intermediate groove 116 which extends partially around the shaft (see FIG. 1) supports shoe 114. A third, deeper notch or groove 118 has a purpose which extends partially around the shaft (see FIG. 1) supports shoe 114. A third, deeper notch or groove 118 has a purpose which will be described subsequently.

The shoe 114 may be welded, soldered or otherwise attached to band or ribbon 24. A drive spring 120 is welded or soldered or otherwise attached to the base of shoe 114 and extends along part of the distance of shoe 114. It will be noted that the ribbon or band 24 has a portion of its center cut out to give a lanced out tab 122.

This lanced out tab structure 122 is similar to that shown for the pullback in FIG. 7. The shoe 114 has a cavity 124 in which is contained a compressible pin 126 which bears against drive spring 120 and which extends through the lanced out portion of band or ribbon 24. A stop member 128 is rigidly secured to and embedded within housing structure 10. The left tip of actuation pin 100 is shown in its non-energized position in FIGS. 2 and 3. When plunger or actuation pin 100 is as shown in FIGS. 2 and 3, the ribbon or band 24 is held out of action due to the interference of lanced out tab 122 with surface 130 of housing 10. The band or ribbon 24 is prevented from being driven in a clockwise direction by stop member 128 as can be seen in FIGS. 2 and 3.

When a particular color of yarn is to be selected and hence the band or ribbon 24 of that unit is to be actuated, the plunger or actuation pin 100 is advanced, thus unlatching spring 122 from surface 130. As spring 122 is unlatched, it applies pressure to the compressible pin 126 which, in turn, depresses the drive spring 120. As can be seen best in FIG. 3, the drive spring 120 is attached to only one end of shoe 114 and thus can be driven outwardly from the shoe by compressible pin 126 as permitted by the shaft 12 structure. As the shaft oscillates, it will reach the position as shown in FIG. 3 at which time the compressible pin 126 will force the lower end of drive spring 120 into engagement with notch 118. As the shaft 12 reverses, drive spring 120 will be driven in the counter-clockwise direction thus driving band member 24. As the band or ribbon 24 advances, the lanced out portion or tab 122 of the ribbon or band 24 becomes trapped within groove 18 formed between the shaft and the stationary housing 10 (as seen in FIG. 4) with the drive spring 120 being held in its drive position. Thus, as can be seen in FIG. 4, the band or ribbon 24 is driven as far as the oscillatory motion of the shaft carries it since the drive spring 120 is engaged in the driving or deepest notch 118. As this counter-clockwise motion of band 24 occurs, it will be appreciated that plunger 28 of FIG. 1 is driven downwardly within pocket or plunger channel 86 and, as will be described, will be carrying yarn engaged by the plunger 28. With further reference to FIG. 1, it will be also noted that since band 32 is secured to both plungers 28 and 34, as plunger 28 descends, plunger 34 must ascend and vice versa as plunger 28 is raised to its non-engaging or actuated position. As the shaft 12 oscillates in a clockwise direction, surface 155 of shaft 12 engages surface 157 of shoe 114 whereby band 24 will be returned to its unactuated position and if actuation pin 100 has been deactivated by the solenoid means, then the lanced out tab 122 will be permitted to return to its position where is abuts against surface 130, and compressible pin 126 will be permitted to release its pressure against drive spring 120 which will return to its non-driving position in juxtaposition against shoe 114 and out of engagement with notch 118. Thus, as the shaft 12 oscillates in a counter-clockwise direction, the next time the band 24 will remain in its stationary non-actuated position. On the other hand, if the same work element 30 is to be used for a second time in succession, the solenoid continues to be actuated and the actuation pin or plunger 100 remains in the position as shown in FIG. 4 thus causing the band 24 to be driven by oscillating shaft 12 for a second cycle and succeeding cycles, if desired.

With reference to FIGS. 5 and 6, the pullback shaft 14 with accompanying pullback band-like member or ribbon 26 is shown. The pullback mechanism differs from that described for the feed mechanism in view of different functional requirements. In the case of the pullback means, the band-like member 26 must drive plunger 30 (see FIG. 1) to its down position in plunger channel or pocket 88 and latch holding the plunger 30 in this position. Accordingly, the band 26 must be selected to push plunger 30 down and deactuated to pull the plunger 30 back to its raised deactuated position.

FIG. 5 is a schematic of the pullback mechanism shown when the solenoid is actuated so that the actuation pin 100 of FIG. 1 is in its leftward position and out of engagement with the pullback mechanism. It will be noted that at this time band 26 is not actuated and this will remain the situation until the solenoid 92 of FIG. 1 is deactuated. Band 26 has lanced out tab 132, the structure of which can best be appreciated from viewing the isometric view of FIG. 7. The band 26 is shown terminating with a second lanced out portion 134 which is engageable with a latching pawl spring 136 that is connected to portion 137 of shaft 14 by welding, soldering or other means at attachment. A stop abutment 138 protrudes inwardly from housing 10 to prevent the band 26 from continuing in a counter-clockwise direction further than shown in FIG. 5.

With further reference to FIG. 5, a shoe 140 is welded or otherwise secured to band 26 and has a cavity in which is positioned a compressible pin 142 similar to that described with reference to FIGS. 2 through 4. A drive spring 144 is soldered or welded or otherwise secured at one end of shoe 140 and functions in a manner similar to drive spring 120 discussed with respect to FIGS. 2–4.

With further reference to FIG. 5, the mechanism is shown in a position where plunger 30 would be in a raised position (contrary to the position as shown in FIG. 1). With no interference from the tip of actuation pin 100, lanced out tab 132 of band 26 has been allowed to spring out into a cavity where it abuts against surface 146 of wall 10. With tab 132 in this position, band 26 is trapped between surface 146 in the one direction and stop 138 in the other direction. As shown pin 142 does not bear against drive spring 144 and the drive spring 144 is therefore permitted to remain in abutment throughout its length against shoe 140.

The oscillatory shaft 14 is shown having a step 148 which oscillates in a counter-clockwise direction to a point below drive spring 144.

As shown in FIG. 5, the actuation pin 100 is driven as far as possible to the left (as shown in FIG. 4), which is the condition where solenoid 92 is on. When the solenoid 92 is turned off, actuation pin 100 pushes tab 132 and compressible pin 142 to apply pressure to drive spring 144 and to clear the tab 132 from its locking position on surface 146. The drive spring 144 thus extends inwardly toward shaft 14 as permitted by the surface configuration of shaft 14. When the shaft 14 oscillates to its position as shown in FIG. 5, the drive spring will snap inwardly to a position which interferes with step 148 and as shaft 14 reverses to oscillate in a clockwise direction, band 26 will be driven to the opposite reversal position of shaft 14 as shown in FIG. 6. At this position, actuation pin 100 (with extension member 100A) drops into a slot 150 in band 26 and pushes pawl spring 136 so that its latch cannot engage lanced tab 134 of slot 150. Slot 150 can best be seen in FIG. 7. Thus, even though shaft 14 will reverse and oscillate in a counter-clockwise direction, band 26 will be held in its forward position with plunger (see FIG. 1) in its down position so long as a solenoid 92 is turned off and actuation pin 100 (extension member 100A) is in the position shown in FIG. 6. When solenoid 92 is turned on, actuation pin 100 shifts to the left (from its position in FIG. 6).

The plunger 100 is shown having a separate, associated member 100A which is desirable because the pullback band 26 must continue to be restrained from moving for a short time after the solenoid 92 is actuated. This is desirable because the solenoid 92 is actuated during the second half cycle while the pullback shaft 14 is turning counter-clockwise. If the member 100A is removed during this period, the pressure applied to plunger 30 by air valve stem 108 could move the band 26 and cause the air to flow prematurely and the pulled back yarn to advance a small amount. The slight pressure of the band 26 against the top side of the separate member 100A keeps the separate member 100A in place after plunger 100 shifts to the left until the pullback latch spring 136 pushes member 100A out of slot 150 at the end of the next clockwise rotation (end of next one-half cycle).

Since member 100A is detached from plunger 100, pin 101, shown in slot 103, prevents member 100A from going too far to the right when engaged by plunger 100 as plunger 100 shifts to the right when solenoid 92 (FIG. 1) is first turned off. A spring or other means could be used in place of the pin 101 and slot 103 arrangement. Thus, member 100A is driven to the right by the impact from plunger 100 when the solenoid is turned off and will remain in its furthermost right position (as far as permitted by pin 101) until latch spring 136 pushes it to the left as permitted by solenoid 92 being turned on causing plunger 100 to shift to the left away from member 100A. When latching pawl spring 136 comes to the position shown in FIG. 6 as shaft 14 oscillates in a counter-clockwise direction, the latching pawl spring 136 will drive member 100A to the left and engage the lanced tab 134 of slot 150 and cause the shaft 14 to drive band 26 to the position as shown in FIG. 5.

With reference to FIG. 6A, a cross-section top view of a portion of shaft 14 is shown with one station (middle) and two partial stations being shown. Each of the stations is separated by the outermost portions 151 (as measured from the center longitudinal axis) of the shaft 14. Immediately adjoining these separator portions 151 are shoulders 153 which have been grooved out to support band-like members 26.

Figure 11:
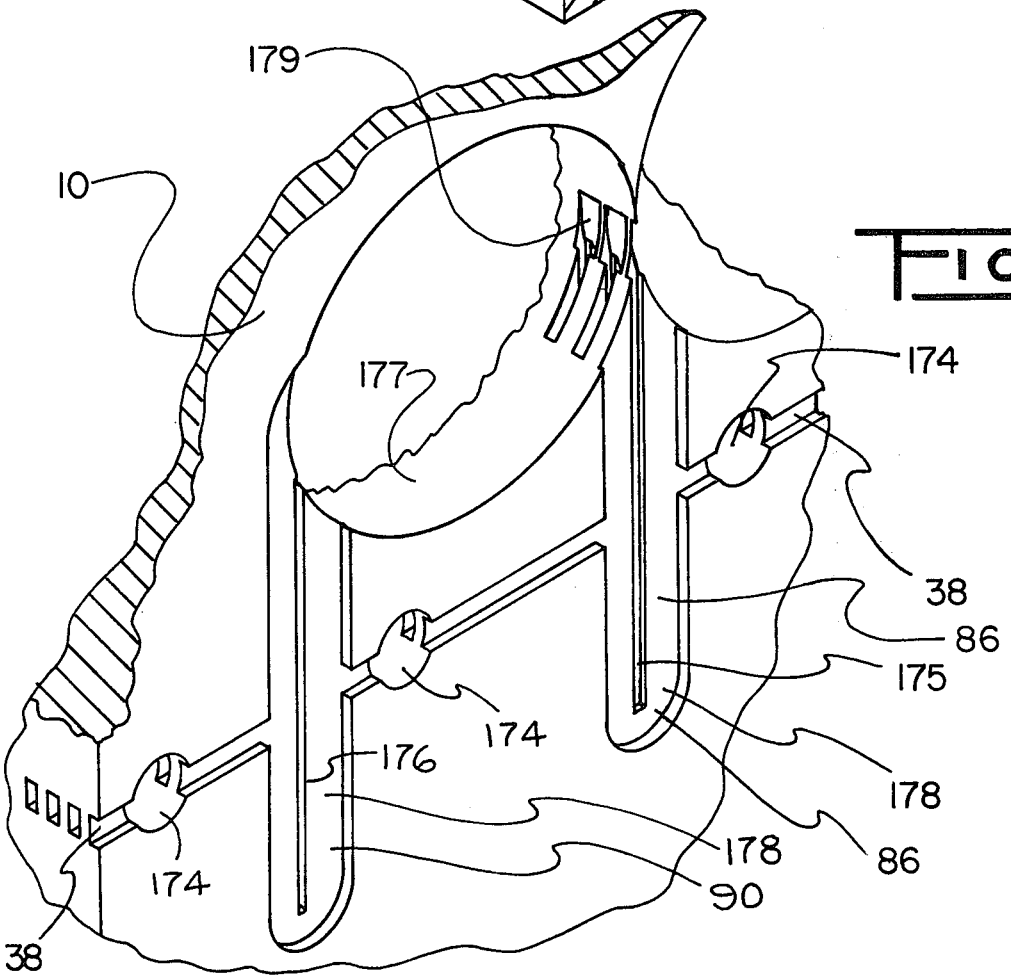
FIG. 11 is an isometric view showing machine housing for yarn clamp, band and plunger structure.

With reference to FIG. 7, bands 24, 26 and 32 are shown in isometric. The respective plungers, 28, 30 and 34 are shown having yarn receiving grooves 152, 154 and 156 which engage yarn as the plungers are driven downward. It will be noted that the width of bands 24, 26 and 32 is wider than the plunger width of plungers 28, 30 and 34 and that accordingly, the bands 24, 26 and 32 extend out farther width-wise than the plungers. This can be clearly seen in those portions where the bands are coextensive with the plungers. The significance of this structure will be discussed when FIG. 11 is described.

With reference to FIG. 8, drive shafts 12 and 14 and idler shaft 16 are shown in isometric. It will be noted from FIG. 8 that the shafts extend width-wise across the machine and service adjacent units. Solenoid 92 is shown along with actuation pin 100 and intermediate elements. A series of actuation pins 100 are shown along with their respective elements 98. While the feeding units may be positioned in many different ways, a preferred embodiment would place different units for different colors for each needle station vertically so that a tier of five or eight units would be used where five or eight colors are desired for each needle station. Accordingly, proceeding width-wise across the machine, each pin 100 would actuate the bands for each succeeding needle station.

Figure 9:
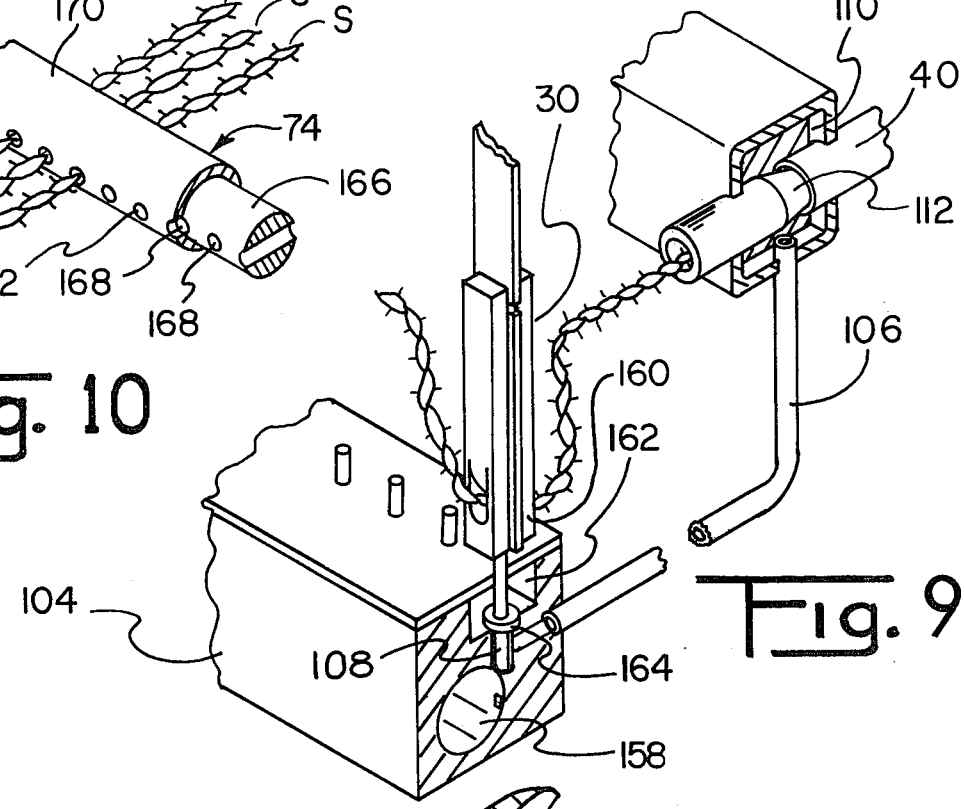
FIG. 9 is an isometric view showing the pneumatic actuation system.

With reference to FIG. 9, a system for introducing air for yarn transport purposes is shown. The air manifold 104 has an air chamber 158 which extends width-wise across the machine. The plunger 30 has an extended block 160 which engages valve means 108, the raising and lowering of which causes the admission and cutting off of air into air conduit 106 leading to air chamber 110. The valving apparatus is further supplemented by cavity 162 in which disc member 164 is restrained to set the limits of the reciprocation of the valving means 108.

Figure 10:
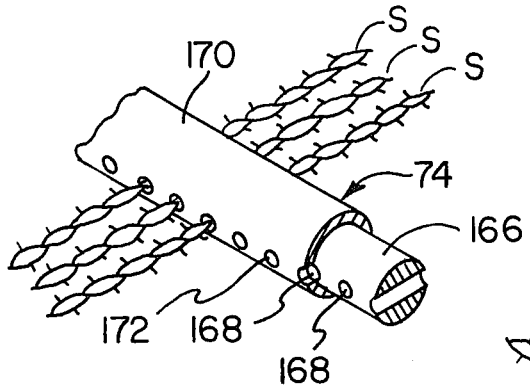
FIG. 10 is an isometric view showing a yarn clamp.

With reference to FIG. 10, a clamp member 74 is shown and it is to be understood that the same structure may be used for clamp members 76 and 78. Clamp member 74 comprises an inner-solid cylindrical member 166 through which diametric bores 168 are made for yarn strands S. An outer cylindrical sleeve 170 has bores 172 alignable with the bores 168 of the innersolid cylindrical member 166. Relative motion between member 166 and sleeve 170 will cause the yarn to be clamped although movement cannot be so great as to shear the yarn strands. The preferable way of clamping the yarn is to drive innersolid cylindrical member 166 to the right or left a slight distance and all three yarn clamps, 74, 76 and 78 are thus operated at regular intervals throughout the yarn operation cycles as indicated regardless of whether the particular yarn of a particular unit is called for within that cycle.

With reference to FIG. 11, a portion of housing 10 is shown. Cavities 174 are shown which house clamping members 74, 76 and 78. Plunger channels or pockets 86 and 90, which house plungers 28 and 34, respectively, can be seen connecting with yarn passageway 38 which is shown extending across housing 10. It will be noted that the plunger channels or pockets, 86 and 90 have vertical grooves, 175 and 176 extending almost the height thereof. These vertical grooves, 175 and 176, are found on both sides of the wall 178 which is present between succeeding units. The edges of the bands, for example band 32, are inserted within the vertical grooves 176 to confine the bands in a linear direction as they extend tangentially away from the shafts, in this case shaft 16. By restraining the bands, 24, 26 and 32 in this manner, the oscillatory motion of the shafts can be translated to reciprocable motion of plungers 28, 30 and 34.

It will be noted that groove 175 is of double thickness for the purpose of guiding both bands 24 and 32 which become coextensive as they lead to plunger 28. Cavity wall 177 defines the cavity which houses shaft 16 and the band 32 enters the cavity circumferentially around shaft 16 through openings defined by walls 179.

It will be appreciated that band-like member 26 is confined in similar fashion as band-like members 24 and 32 as has been described above. Each of the bands is restrained in groove-like tracks at the point where they extend away from their respective shafts as has been shown for bands 24 and 32.

Figure 12:
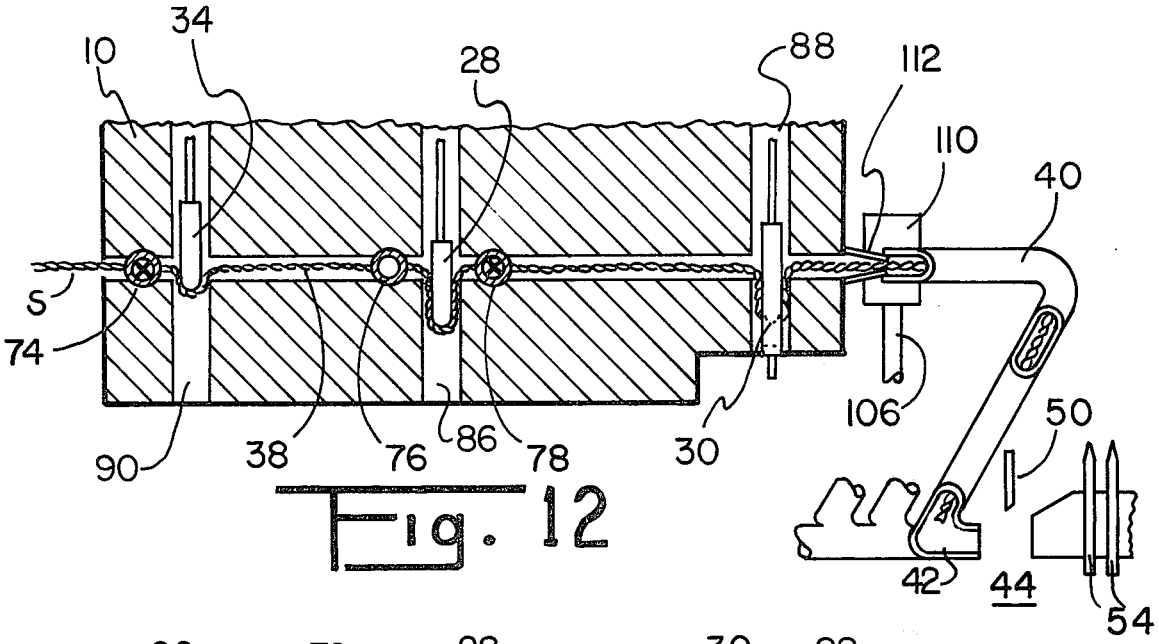
FIGS. 12–14 show sequential cross-section views depicting the operation of the yarn control apparatus; and, FIG. 15 is a schematic view of an alternate embodiment of a tufting machine.
Figure 13:
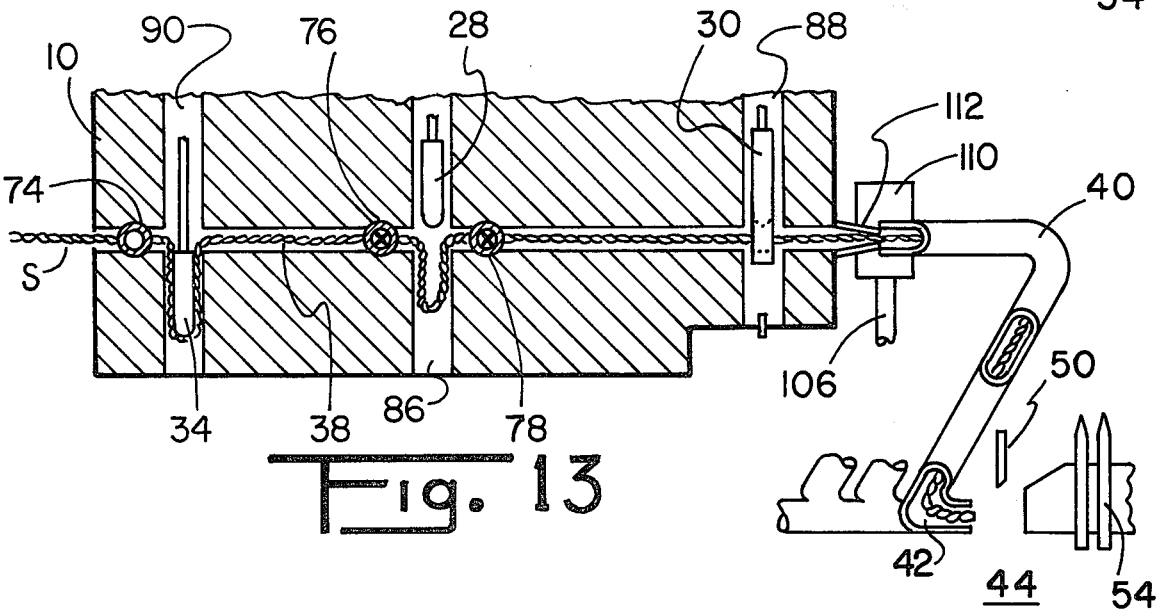
Figure 14:
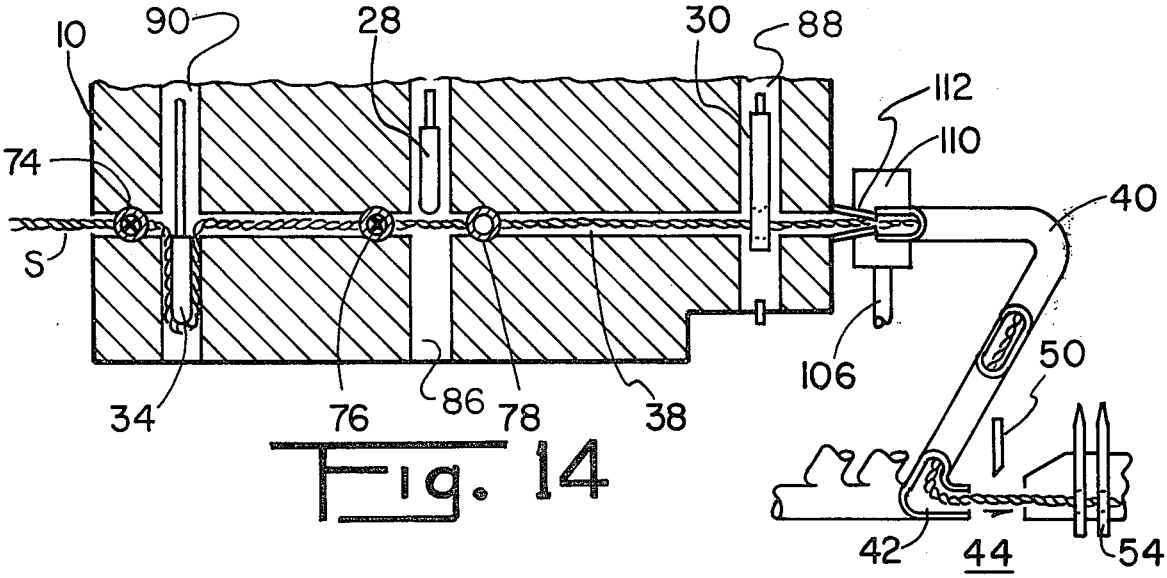

With respect to the operation of the apparatus disclosed herein, FIG. 1 along with FIGS. 12–14 will serve as sequential views depicting various stages of the yarn feeding and metering operations. With reference to FIG. 1, the unit shown is in a stand-by position while another unit (not shown) is supplying yarn to needles 54. The solenoid 92 is off and actuation pin 100 is engaged with band 26 so that plunger 88 is in its down position. Plunger 34 has previously pulled and held a surplus of yarn from the creel and plunger 30 has pulled back and held the yarn from the delivery tube or common passageway 42. The downward position of plunger 30 also prevents air from reaching the Venturi Nozzle 112 as valve means 108 is in a closed position. Yarn clamp 76 is on and clamping as indicated by the X on the clamp.

The solenoid 92 may be selected at any time during the second half of the previous cycle. FIG. 12 shows the unit after it has been selected by actuation of solenoid 92 and after the first half cycle is complete. During this first half cycle, the unit that was previously feeding yarn has pulled back its yarn from the delivery tube or common passageway 42. With respect to the clamping means during this first half cycle, yarn clamp 74 is clamping, yarn clamp 76 is off and yarn clamp 78 is clamping. Yarn is metered from pocket 90 to pocket 86 under low tension as plunger 34 ascends and plunger 28 descends. This is caused by solenoid actuation pin 100 forcing drive spring 120 into engagement with oscillating shaft 12 (see FIG. 1) as the shaft 12 oscillates in a counter-clockwise direction.

FIG. 13 shows the unit near the end of the second one half cycle during which clamp 74 is off, clamp 76 is clamping and clamp 78 is clamping. Plunger 34 has descended as shaft 12 has oscillated back in a clockwise direction and has nearly completed pulling yarn from the creel while plunger 28 has cleared the straight line path of the yarn through passageway 38. Plunger 30 has released the pulled back yarn in pocket 88 by ascending and in so doing has turned on air pressure by raising valve means 108 to permit air flow to Venturi nozzle 112 thus causing the yarn to advance into the common passageway 42.

FIG. 14 is similar to FIG. 13; however, clamps 74 and 76 are clamping and clamp 78 is off or in the open position allowing yarn metered into pocket 86 to be advanced to the right by the air pull caused by air flowing through Venturi 112 and delivery tube 40. At this time, the free end of the yarn strand S is blown through the eyes of needles 54 or into receiving position for any type of bit-applying elements after which time the yarn is cut into a discrete bit by knife or cutting means 50.

If a second tuft of the same color (from the same unit) is to be tufted, solenoid 92 (FIG. 1) remains actuated causing actuation pin 100 to stay in its position to the left causing a repeat of the steps in FIGS. 12–14, except for the operation of the pullback plunger 30 which stays in its up position since the conditions of FIG. 5 are held until solenoid 92 is deactuated which would cause solenoid pin 100 to shift to the right thus causing pullback plunger 30 to withdraw yarn from common throat 42.

After the last desired yarn length from a particular unit is tufted, the solenoid 92 will be deactuated causing pin 100 to force band 28 into engagement with shaft 14 thereby causing yarn from common passageway 42 to be withdrawn. The pullback operation occurs during the first half of the next cycle and the stand-by condition as shown in FIG. 1 is once again achieved.

It is to be noted that the forces required to move actuation pin 100 are very low and easily provided by a small electric solenoid. The forces provided by ribbon or band 24 which is preferably a thin, non-deformable but flexible steel band and the shaft 12 are limited only by the compression strength of the drive spring 120. Thus, with the apparatus described above, a number of functional operations can be accomplished. Thus, it is possible to pull an excess amount of yarn under tension from the creel during approximately one-half tufting cycle and hold it until it is needed. It is also possible to meter an exact amount of yarn from the excess amount of yarn under tension in approximately one-half cycle and hold it until it is required during the second one-half of the same cycle. The yarn thus metered can be released at a programmed time and all of the above steps can be repeated until controlled to stop. When stop feed command (solenoid off) is given at any time during the second half of the cycle prior to the release of yarn, the operations will stop when the release is completed. After a controlled stop is signalled and the yarn is released, a constant non-variable length of yarn will be pulled back into a reservoir and held until the next feed start is signalled. During the second half of a new feed cycle, the pullback yarn will be advanced to the common throat position which it was drawn from when pulled back.

It should be noted that with respect to the construction of the band-like member and the oscillating shaft, the smaller the shaft is, the thinner the band must be. Since the band should not take permanent deformation, Hook's Law of Stress should not be surpassed. While hardened stainless steel is preferred for the band-like member, plastic bands and other metal bands can be used as well, so long as they do not take permanent deformation. As, for example, it has been found that stainless steel bands on the order of 1/100 of an inch in thickness are acceptable for the operations discussed herein using a five inch drive shaft.

Figure 15:
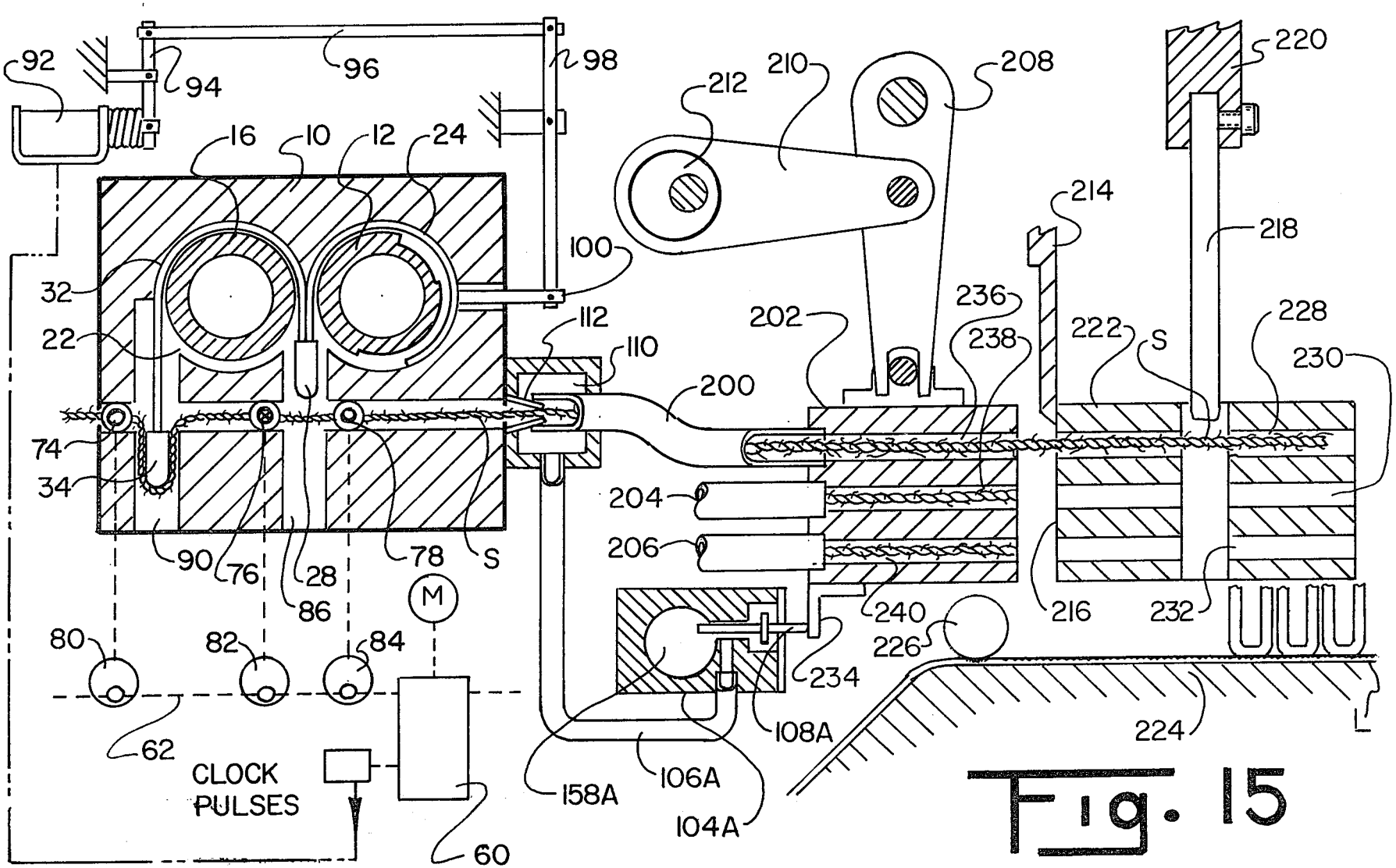

With reference to FIG. 15, a modified embodiment of the subject invention is disclosed. It will be noted that in the embodiment of FIG. 1, yarn extended through a common passageway portion 42 to a position where knife 50 would sever the yarn into bits. Since the unsevered length of yarn extended into the common throat or common passageway 42, it was necessary to utilize pullback apparatus to retract the unsevered portion of the yarn preparatory to selection of a yarn of different color from a different unit.

In FIG. 15, the common throat or passageway structure 42 has been eliminated, thus permitting the elimination of the pullback apparatus comprising pullback shaft 14, pullback band 26 and pullback plunger 30.

Yarn feed tube 200 is an extension of passageway 38 and leads to a collector unit 202 along with other input feed tubes 204 and 206 from other units. The tubes or passageways 200, 204, 206 are flexible or have flexible portions to permit the lateral shifting of the collector unit 202. Drive lever 208 for collector unit 202 is controlled by cam 212 through linkage 210 to permit the lateral shifting of collector unit 202 to the right to permit knife member 214 to sever yarn into bits as will be subsequently discussed.

Channels or passageways 236, 238 and 240 extend through collector unit 202 and guide the yarn to one of corresponding channels 228, 230 and 232 of yarn guide structure 222. Once a yarn strand is fed to the yarn guide structure 222, collector unit 202 will be shifted to the left to permit knife member 214 access to sever the yarn. The front surface 216 of yarn guide structure 222 may serve as an anvil against which the yarns are severed into bits.

As collector unit 202 shifts to the left, projection 234 will cause air valve 108A to be closed to prevent the flow of air through air tube 106A. Elements 104A and 158A are similar to elements 104 and 158 previously described as are all other like reference numerals shown in FIG. 15 which correspond with reference numerals from previously discussed figures. Thus, the air is shut off allowing knife member 214 to sever a yarn bit for tufting without the need of restraining the yarn bit to prevent it from being blown from its position after severance.

The tufting station for the embodiment in FIG. 15 is shown comprising a stomper member 218 which is driven by bar member 220, similar to a conventional needle bar, to which all stompers 218 are attached. The passageways 228, 230, 232 of guide structure 222 channel yarns from the three units to positions below stomper 218 whereby they may be driven onto backing layer L once loaded and severed. The backing layer L is shown supported by backing support 224 and an adhesive applying unit 226 is shown on the top side of backing layer L for applying adhesive to the top side of the backing where the yarn bits are received. Once a yarn bit is tufted, the collector unit 202 is shifted to the right to close the knife access gap from which knife member 214 has withdrawn after performing the severing step, preparatory to the feeding of the next yarn strand.

While collector unit 202 is shown receiving yarns from three units, it will be understood that this number may vary and additional yarns enabling more colors may be received.

The present invention may be embodied in other specific forms without departing from the spirit or essential attributes thereof, and, accordingly, reference should be made to the appended claims, rather than to the foregoing specification as indicating the scope of the invention.

What is claimed is:

1. Tufting apparatus including bit-applying means for applying tufts to a backing layer wherein the improvement comprises a yarn supply system having:

feeding means including yarn displacement metering means;

means for controlling said feeding means including:

an oscillatory feeding shaft;

a flexible feeding band member engageable with said oscillatory feeding shaft, said band member being extendable within a track to prevent unwanted flexing, said track extending to a yarn plunger for engaging yarn; and, means to cause said feeding band member to engage with said oscillatory feeding shaft enabling said feeding band member to be driven when said feeding shaft oscillates; and, pneumatic yarn transport means to transport the yarn to said bit-applying means.

2. The tufting apparatus of claim 1 including collator structure wherein multiple feeding means are utilized to feed yarns through pneumatic yarn transport means to a common passageway leading to said bit-applying means.

3. The tufting apparatus of claim 2 wherein said tufting apparatus includes severing means for severing yarn into discrete bits after the yarn has been transported into said common passageway and extends to said bit-applying means.

4. The tufting apparatus of claim 3 further including yarn pullback means for retracting the unsevered portion of yarn from said common passageway after severing, comprising:

an oscillatory pullback shaft;

a pullback band member engageable with said oscillatory pullback shaft and including a yarn pullback plunger for engaging yarn and retracting it from said common passageway;

means to cause said pullback band member to engage with said oscillatory pullback shaft enabling said pullback band member to be driven when said pullback shaft oscillates; and, means to hold said pullback band member in a driven position to retain the yarn in a pulled-back position.

5. The tufting apparatus of claim 4 wherein air for said pneumatic yarn transport means is controlled by the operation of said pullback band member.

6. The tufting apparatus of claim 4 wherein said means to cause said feeding band member to engage with said oscillatory feeding shaft and said means to cause said pullback band member to engage with said oscillatory pullback shaft have a common control.

7. The tufting apparatus of claim 5 wherein the actuation of said means to cause said feeding band member to engage with said oscillatory feeding shaft causes the deactuation of said means to cause said pullback band member to engage with said oscillatory pullback shaft.

8. The tufting apparatus of claim 5 wherein the actuation of said means to cause said pullback band member to engage with said oscillatory pullback shaft causes the deactuation of said means to cause said feeding band member to engage with said oscillatory feeding shaft.

9. The tufting apparatus of claim 1 wherein said feeding means further includes a second yarn displacement metering means.

10. The tufting apparatus of claim 9 including clamp means utilized for advancing yarn in conjunction with said first and second yarn displacement metering means.

11. The tufting apparatus of claim 1 including a plurality of feeding band members and further comprising means of selectively engaging at least one of said band members with said oscillatory feeding shaft responsive to selection signals whereby yarn of particular characteristics may be chosen for tufting.

12. The tufting apparatus of claim 1 wherein one of said oscillatory feeding shaft or feeding band member has a notch and the other has a protrusion, said apparatus further comprising means of driving said protrusion into said notch to cause said feeding band member to be engaged by said oscillatory feeding shaft.

13. The tufting apparatus of claim 1 further including structure in close proximity to said oscillatory feeding shaft forming a peripheral track around at least a portion of said oscillatory feeding shaft and wherein a portion of structure in close proximity to said oscillatory feeding shaft has an abutment and wherein said feeding band member includes an engageable portion which is engageable with said abutment to prevent movement of said feeding band member unless actuated.

14. The tufting apparatus of claim 13 further including plunger means for driving said engageable portion of said feeding band member free from said abutment and for driving said feeding band member into engagement with said oscillatory feeding shaft.

15. The tufting apparatus of claim 1 wherein said means to cause engagement comprises a solenoid and a solenoid plunger element.

16. The tufting apparatus of claim 1 wherein said feeding means includes a prefeed yarn means.

17. The tufting apparatus of claim 16 wherein said prefeed yarn means comprises:

a prefeed band member connected to said feeding band member yarn plunger;

a prefeed plunger connected to said prefeed band member; and, a shaft over which said prefeed band member extends so that reciprocation of said feeding band member yarn plunger occurs simultaneously and in opposite direction of reciprocation of said prefeed plunger.

18. In a tufting machine:

reciprocable bit-applying means movable through a backing to and from a loading position on a selected side of the backing;

metering means, utilizing a displacement plunger element for advancing a predetermined length of tufting material, said metering means including a flexible band member connected to said plunger element;

driving means for said band member engageable with said band member, said band member being restrained by a track to prevent unwanted flexing of said band member so as to be reciprocable when engaged by said driving means;

means to selectively engage said band member with said driving means; and pneumatic means for transporting said predetermined length of tufting material to said bit-applying means.

19. In a tufting machine:

reciprocable bit-applying means movable through a backing to and from a loading position;

metering means, utilizing a displacement plunger element for advancing a predetermined length of tufting material, said metering means including a flexible band member connected to said plunger element;

driving means for said metering means including an oscillatory shaft engageable with said band member, said band member being restrained by a track to prevent unwanted flexing so as to be reciprocable when engaged by said oscillatory shaft;

means to selectively engage said band members with said driving means;

pneumatic means for transporting said predetermined length of tufting material to said bit-applying means; and, severing means for severing a bit-length of tufting material from said advanced, predetermined length of tufting material.

* * * * *

UNITED STATES PATENT OFFICE

CERTIFICATE OF CORRECTION

Patent No. 4,047,491 Dated September 13, 1977

Inventor(s) Abram N. Spanel (Eiland) (Jacobs)

It is certified that error appears in the above-identified patent and that said Letters Patent are hereby corrected as shown below:

Column 3, line 39, delete "system" and insert --station--.

Column 4, line 22, delete "without" and insert --with--.

Column 4, line 26, after "band", insert --26--.

Column 4, lines 59-61, delete "A third, deeper notch cr groove 118 has a purpose which extends partially around the shaft (see Fig. 1) supports shoe 114".

Column 5, line 2, after "pullback" insert --band--.

Column 5, line 53, delete "is" and insert --it--.

Column 8, line 22, delete "inner-solid" and insert --innersolid--.

Signed and Sealed this

*Twenty-seventh* Day of *December 197*

[SEAL]

*Attest:*

RUTH C. MASON
*Attesting Officer*

LUTRELLE F. PARKER
*Acting Commissioner of Patents and Trademark*